US007812780B2

(12) United States Patent
Heuermann

(10) Patent No.: US 7,812,780 B2
(45) Date of Patent: Oct. 12, 2010

(54) ANTENNA ARCHITECTURE AND LC COUPLER

(75) Inventor: Holger Heuermann, Stolberg-Breinig (DE)

(73) Assignee: Fachhochschule Aachen, Aachen (DE)

( * ) Notice: Subject to any disclaimer, the term of this patent is extended or adjusted under 35 U.S.C. 154(b) by 710 days.

(21) Appl. No.: 11/667,508

(22) PCT Filed: Nov. 8, 2005

(86) PCT No.: PCT/DE2005/002002

§ 371 (c)(1),
(2), (4) Date: Jun. 27, 2007

(87) PCT Pub. No.: WO2006/050701

PCT Pub. Date: May 18, 2006

(65) Prior Publication Data

US 2008/0030421 A1 Feb. 7, 2008

(30) Foreign Application Priority Data

Nov. 10, 2004 (DE) ..... 10 2004 054 442

(51) Int. Cl.
*H01Q 21/00* (2006.01)

(52) U.S. Cl. ..... 343/853; 343/860

(58) Field of Classification Search ..... 343/853, 343/860

See application file for complete search history.

(56) References Cited

U.S. PATENT DOCUMENTS 5,760,645 A * 6/1998 Comte et al. ..... 329/304
6,509,883 B1 * 1/2003 Foti et al. ..... 343/850
7,206,566 B1 * 4/2007 Lynch ..... 455/313
7,359,672 B2 * 4/2008 Lynch ..... 455/7

FOREIGN PATENT DOCUMENTS

GB 1 207 511 A 10/1970
WO WO 2004/051878 A 6/2004

OTHER PUBLICATIONS

Bezooijen et al., "Adaptively Preserving Power Amplifier Linearity under Antenna Mismatch," IEEE, IMS 2004, Forth Worth, pp. 1515-1518. (Spec, p. 3).
International Search Report.
English translation of International Preliminary Report on Patentability.
Schiek, Burkhard, "Measurement Systems of High-Frequency Technology," Hüthig Verlag, 1984, pp. 25-26. (With English translation of pertinent portions) (Spec, p. 6).

* cited by examiner

*Primary Examiner*—Tan Ho
(74) *Attorney, Agent, or Firm*—Collard & Roe, P.C.

(57) ABSTRACT

Disclosed is an antenna architecture for the non-reacting connection of an antenna to a power amplifier, the antenna being connected to the power amplifier via a coupler. The inventive architecture is improved by the fact that the coupler is provided with an input gate for feeding the signal that is to be transmitted to the antenna while comprising a first and a second antenna gate for transmitting the signal to the antenna, the input gate and the load gate encompassing a joint gate terminal and the first and the second antenna gate being equipped with a joint gate terminal. Furthermore, the antenna comprises a first and a second, identically designed individual antenna, the first individual antenna being connected to the first antenna gate and the second individual antenna being connected to the second antenna gate. Additionally, an adjusted terminating resistor is connected to the load gate while the coupler transmits the signal to the first antenna gate at a phase angle of 0° and to the second antenna gate at a phase angle of 90°.

20 Claims, 2 Drawing Sheets

ANTENNA ARCHITECTURE AND LC COUPLER

CROSS REFERENCE TO RELATED APPLICATIONS

Applicant claims priority under 35 U.S.C. §119 of World International Patent Organization Application No. WO 2006/050701 filed May 18, 2006. Applicant also claims priority under 35 U.S.C. §365 of PCT/DE2005/002002 filed Nov. 8, 2005. The international application under PCT article 21(2) was not published in English.

BACKGROUND OF THE INVENTION

1. Field of the Invention

The present invention relates to an antenna architecture for non-interacting connection of an antenna to a power amplifier, the antenna being connected to the power amplifier via an LC coupler, as well as an LC coupler.

2. Description of the Related Art

In a modern wireless communication system, such as the mobile wireless standard UMTS or in a wirelessly networked computer network, a so-called wireless local area network (WLAN), the digital data to be transmitted is transmitted via a wireless connection in the gigahertz range. For example, in the UMTS standard, frequencies between 1,900 and 2,170 GHz are used and frequencies around 2.4 GHz are used for a WLAN. For wireless signals of these frequencies, the wavelengths are a few centimeters and thus in the microwave range. Wireless signals of this wavelength may thus be interfered with by comparatively small objects, the interference effect of an object being a function of the distance of the object to the antenna and the electrical conductivity of the object. The lower the distance of the object to the antenna and the greater its electrical conductivity, the stronger the interference with the wireless signal transmitted by the antenna. The interference may cause the propagation of the wireless signal to be impaired, in addition, the wireless signal may be deflected in its direction, in particular reflected, so that the reflected component is guided back to the antenna, for example.

If necessary, and particularly in the case in which an object having good electrical conductivity is in proximity to the antenna, not only does an object interfere with the propagation of the emitted signals, but rather, for example, due to the small distance, changes of the antenna characteristic also result, in particular of the input resistance of the antenna.

In practice, the antennas of such a UMTS or WLAN device are connected nearly directly to a power amplifier, so that the resistors must be adapted for optimum transmission of the transmission power between the power amplifier and the antenna. In the ideal state, i.e., if no interfering object in proximity to the antenna changes the antenna characteristic, adaptation is provided. However, if the input resistance of the antenna changes, this results in a change of the operating point of the power amplifier and the transmission behavior. In practice, the value of the error vector magnitude (EVM value) rises, which is used as a measure of the linearity deviation of high-frequency power amplifiers.

However, to achieve a high data transmission rate, linear transmission behavior of the upstream power amplifier must be achieved. A shift of the operating point of the power amplifier, which is accompanied by a rising EVM value, is thus disadvantageous. Attempts to design a power amplifier as so robust in its behavior that a proximal object having good electrical conduction does not influence the operating point have remained unsuccessful until now.

It is known from the prior art that in such systems so-called "isolators" are used, which are connected between the antenna and the power amplifier and "isolate" the power amplifier from the antenna to thus prevent feedback on the power amplifier. These isolators thus cause the operating point of the power amplifier not to be shifted from the ideal point. Furthermore, in addition to these isolators, which comprise passive elements, work has also been done on electronic regulating solutions, in which electronic regulators are used. Such isolators and electronic regulating solutions are described, for example, in Bezooijen A., Chanlo Ch., Roermund A. H. M., Adaptively Preserving Power Amplifier Linearity under Antenna Mismatch, IMS2004, Fort Worth.

The use of such isolators known from the prior art has multiple disadvantages. Isolators are costly, they require a large amount of space, and they have a high weight in comparison to other components. Furthermore, they have a high damping, so that the output power output by the power amplifier is not transmitted optimally to the antenna and thus emitted. This results in an increased power consumption by the amplifier and therefore, in particular in battery operated mobile wireless devices, such as UMTS mobile telephones, so-called handsets, result in the batteries draining rapidly. Furthermore, the isolators based on electronic regulation may tend toward instability because of the feedback control circuit, which possibly causes further undesired interference. The use of isolators of this type for decoupling the antenna from the power amplifier is thus possible, but connected with great disadvantages and difficulties.

SUMMARY OF THE INVENTION

The object of the present invention is therefore to suggest a non-interacting and adapted antenna architecture. To achieve this, a circuit is also to be suggested, which may be implemented using the fewest and simplest components possible.

To achieve this object, an antenna architecture according to the preamble of Claim 1 suggested, which is characterized in that the LC coupler has an input gate for feeding the signal to be transmitted to the antenna and a first antenna gate and a second antenna gate for transmitting the signal to the antenna, the antenna has a first individual antenna and a second, identical individual antenna, the first individual antenna being connected to the first antenna gate and the second individual antenna being connected to the second antenna gate, the load gate is connected to an adapted terminating resistor, and the LC coupler transmits the signal to the first antenna gate with a phase shift of 0° and to the second antenna gate with a phase shift of 90°.

In the present context, the term "LC coupler" comprises all coupler architectures which make use of "lumped elements", i.e., concentrated components such as SMD components, thin-film or thick-film elements, semiconductor elements, capacitors or coils and similar assemblies.

The LC coupler preferably also has a load gate, at which a signal not emitted by an antenna and reflected may be decoupled, so that it is ensured in a simple and operationally reliable way that this reflected signal no longer reaches a power amplifier.

The suggested antenna architecture thus preferably comprises a four-gate 0°/90° LC coupler and an antenna, which is formed by two identical individual antennas, and a terminating or load resistor, which is adapted in its resistance value to the system impedance. The input gate of the LC coupler is connected to the power amplifier and the load gate is terminated by the terminating resistor. Each of the two identical individual antennas is connected to one antenna gate.

The LC coupler causes a wave running from the output into the LC coupler to finally be absorbed in the adapted terminating resistor. Therefore, wave components which are reflected on an object located in proximity to the antenna and are received by one of the individual antennas are absorbed in the terminating resistor of the LC coupler and thus do not interact with the power amplifier. In this regard, the LC coupler acts like an isolator in relation to the power amplifier for the waves running from the output into the circuit, so that the 0°/90° coupler forms an isolator antenna in connection with the two individual antennas.

For the simplest possible implementation of such an antenna architecture, alternatively and/or cumulatively, a 0°/90° coupler is suggested which has an input gate, a load gate, as well as a further first gate and a further second gate, each gate being formed by a first gate terminal and a second gate terminal. No components which are significantly active in the operating frequency range, i.e., which influence the signals ohmically or in another way, are located between the gate terminals of neighboring gates, so that two gate terminals of neighboring gates are each coincident in one gate terminal and may form a joint gate terminal, of course, negligible and never entirely avoidable residual resistances, inductances, and capacitances existing or able to exist. A configuration of this type is referred to as short-circuited in the present case, so that the first gate terminal of the input gate and the first gate terminal of the first further gate are short-circuited, the second gate terminal of the input gate and the first gate terminal of the load gate are short-circuited, the second gate terminal of the first further gate and the first gate terminal of the second further gate are short-circuited, and the second gate terminal of the second further gate and the second gate terminal of the load gate are short-circuited.

Therefore, the first gate terminal of the input gate is preferably the first gate terminal of the first further gate and the second gate terminal of the input gate is preferably the first gate terminal of the load gate. The second gate terminal of the first further gate is the first gate terminal of the second further gate and its second gate terminal is preferably the second gate terminal of the load gate. The 0°/90° coupler therefore only has four gate terminals.

The LC coupler is characterized in that the first gate terminal of the input gate is connected via a first LC element to the second terminal of the second further gate and the second gate terminal of the input gate is connected via a second LC element to the second gate terminal of the first further gate, and the dimensioning of the two LC elements causes a phase shift of 90° between the two signal transmission paths in the provided operating frequency range.

Therefore, the 0°/90° coupler may particularly be implemented having only two passive components, which cause the desired phase shift in the signal transmission paths in the range of the operating frequency of the 0°/90° coupler.

On the other hand, couplers are known as a possibility from the prior art for connecting two signal-conducting circuits to one another in such a way that an exchange of the signals may occur. Thus, a line coupler is cited as a possibility for defined signal attenuation or signal damping in the publication, "Messsysteme der Hochfrequenztechnik [Measurement Systems of High-frequency Technology]", Burkhard Schiek, Hüthig Verlag 1984, and it is specified that couplers may be used for the purpose of dividing signals onto multiple gates. Finally, it is specified that line couplers may be used for the purpose of generating two signals having wideband 90° phase shift. A schematically outlined ring coupler is specified as one example. Furthermore, a resistive coupler is cited, which exclusively has equivalent resistances, i.e., purely ohmic resistors as coupler resistors, and is specified for an exemplary calculation to define the damping. A phase shift between the gates is not possible with these resistive couplers because of the use of the purely equivalent resistances. Finally, it is specified for these resistive couplers that the coupler resistors may also be complex. Thus, for example, one equivalent resistance may be replaced by an inductor and the other equivalent resistance may be replaced by a capacitor. The coupler would then be loss free and decoupled in a wideband manner from a gate, but the coupling itself would be frequency-dependent.

The use of "lumped elements" allows the electrical length to be limited to 20° in the LC couplers according to the present invention. In this way, the corresponding couplers may be constructed very small and may particularly also be used in mobile devices without further measures. However, it is obvious that the limitation of the electrical length of the coupler to 20° or 18° or particularly 15° is also advantageous independently of the use of "lumped elements" to provide robust antenna architectures having a small construction for non-interacting connection of an antenna to a power amplifier, in which the antenna is connected via a coupler to the power amplifier, the coupler having an input gate for feeding the signal to be transmitted to the antenna and a first antenna gate and a second antenna gate for transmitting the signal to the antenna, the antenna having a first individual antenna and a second, identical individual antenna, the first individual antenna being connected to the first antenna gate and the second individual antenna being connected to the second antenna gate, the load gate being terminated, and the coupler transmitting the signal to the first antenna gate using a first phase and to the second antenna gate using a second phase, which is shifted by 90° to the first phase.

BRIEF DESCRIPTION OF THE DRAWINGS

There are multiple possibilities for implementing the antenna architecture and the 0°/90° LC coupler according to the present invention advantageously. In the following, multiple preferred exemplary embodiments of the antenna architecture and the 0°/90° LC coupler are described on the basis of drawings.

DETAILED DESCRIPTION OF THE PREFERRED EMBODIMENTS

Figure 1:
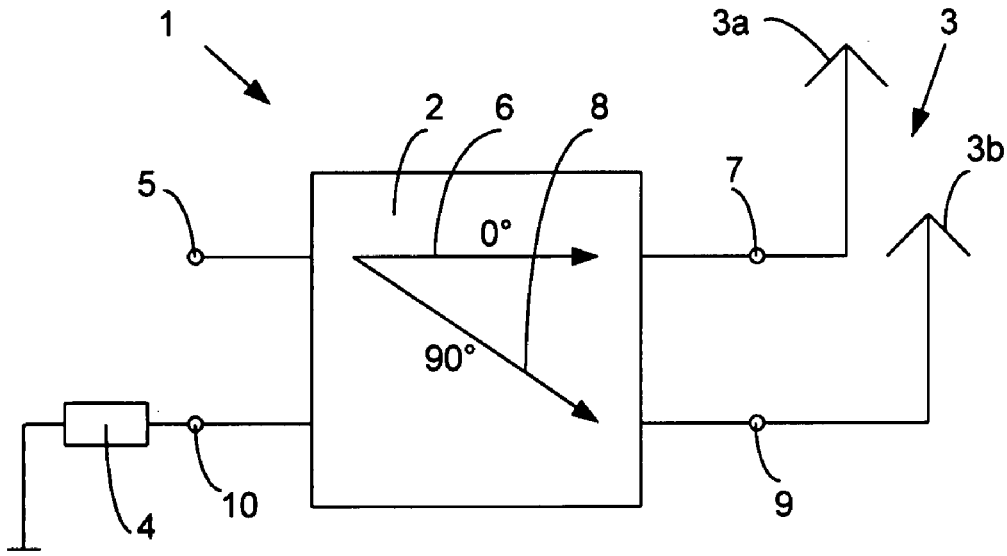
FIG. 1: shows a schematic circuit diagram of the antenna architecture.

FIG. 1 shows a schematic circuit diagram of the antenna architecture 1 having a 0°/90° LC coupler, an antenna 3, which is formed by two identical individual antennas 3*a*, 3*b*, and a terminating resistor 4. The input gate 5 of the 0°/90° LC coupler 2 is connected via the non-phase-shifted signal transmission path 6 to the first antenna gate 7, to which the individual antenna 3*a* is connected. The input 5 is connected via the signal transmission path 8, which phase shifts by 90°, to the second antenna output gate 9, to which the partial antenna 3*b* is connected. The terminating resistor 4, which is tailored in its resistance value to the system impedance of the 0°/90° coupler, is connected to the fourth gate of the LC coupler, the load gate 10.

If a wave runs from a power amplifier (not shown here) via the input gate 5 into the 0°/90° coupler 2, this wave is transmitted via the non-phase-shifted signal transmission path 6 to the first antenna gate 7 and thus to the partial antenna 3*a*. In addition, the wave is transmitted via the signal transmission path 8, which phase-shifts by 90°, to the second antenna gate 9 and thus to the second partial antenna 3*b*. The wave signal fed into the 0°/90° coupler is thus divided onto the two signal transmission paths 6, 8 and emitted by the first partial antenna 3*a* without phase shift and by the second partial antenna 3*b* having a phase shift of 90°.

Therefore, each of the partial antennas 3*a*, 3*b* only has to emit half of the energy output by the power amplifier, so that the partial antennas 3*a*, 3*b* only have to be designed for half of the energy delivered by the power amplifier. Therefore, the partial antennas 3*a*, 3*b* only have to be designed for half of the current carrying capacity in relation to the classical solution using an antenna and isolators, so that this antenna architecture may also be implemented in media which were hardly possible for the classic construction using one antenna. The configuration is additionally significantly more robust to interfering influences, because frequently only one of the two partial antennas is engaged by an interference of this type.

A further advantage is that the directional characteristic of the antenna 3 may be optimized, so that in a mobile wireless telephone, for example, the electromagnetic stress of a user may be reduced.

The configuration has the advantage in particular that a wave reflected by an antenna and/or a wave running from the output into the circuit is absorbed in the terminating resistor 4 and is thus not reflected to the input gate.

For example, a 0°/90° hybrid coupler may be used as the LC coupler, which is especially suitable if the partial antennas 3*a*, 3*b* and the input gate 5 are constructed in asymmetrical line technology. It is obvious that other 0°/90° couplers may also be used.

Figure 2:
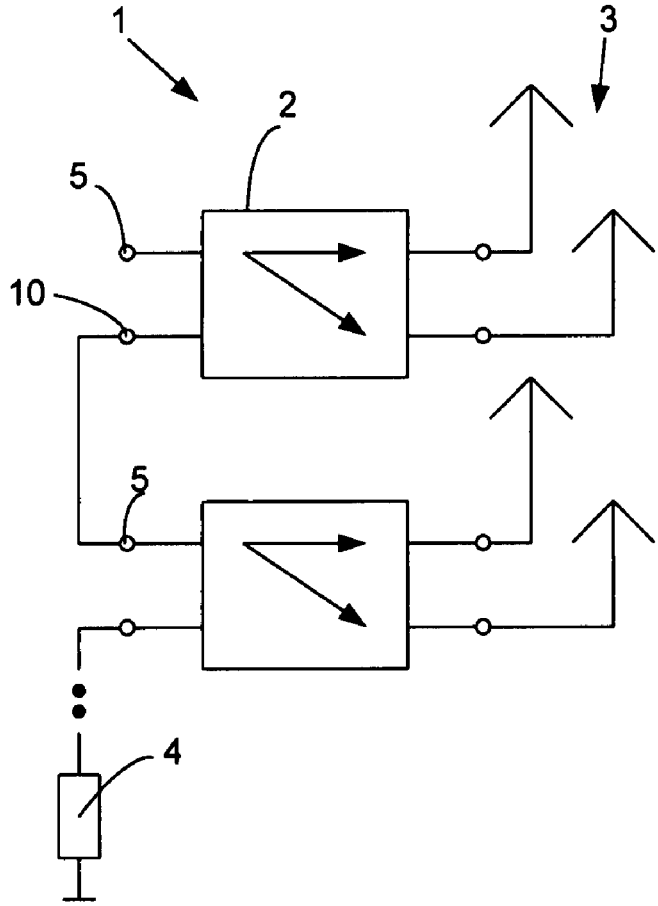
FIG. 2: shows a schematic circuit diagram of the antenna architecture having multiple 0°/90° couplers connected in series.

FIG. 2 shows a schematic circuit diagram of the antenna architecture 1 having multiple 0°/90° couplers connected in series. The power amplifier is connected to the input gate 5 of the uppermost 0°/90° coupler 2. The input gate 5 of the second 0°/90° coupler is connected to the load gate and of the first 0°/90° coupler 2. Multiple 0°/90° couplers 2 may thus be connected one after another in series, one input gate 5 of a 0°/90° coupler always being connected to the load gate 10 of the preceding 0°/90° coupler and thus forming its terminating resistor. Only the last 0°/90° coupler 2 in the series must be terminated using an adapted terminating resistor 4. The 0°/90° couplers in this series circuit may then advantageously be designed in such a way that they are dimensioned for various operating frequencies adjoining one another, so that an ultra wideband antenna or UWB antenna is thus formed and thus the antenna architecture may be used over a broad frequency range. In addition, separate frequency bands may be activated if the operating frequencies do not border one another.

Figure 3:
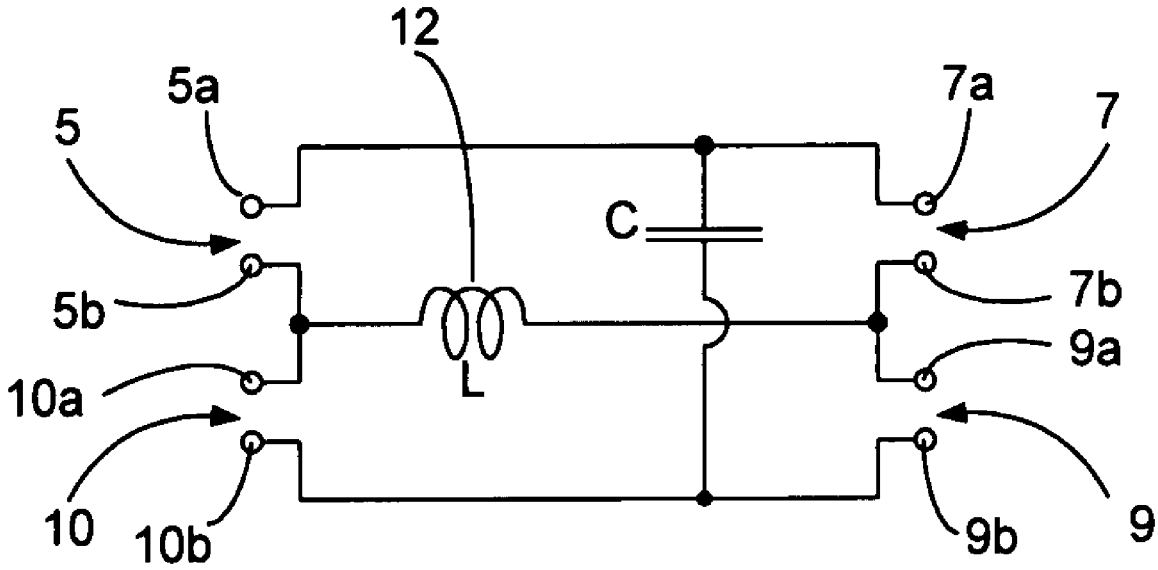
FIG. 3: shows a circuit diagram of a 0°/90° coupler.

FIG. 3 shows a 0°/90° coupler 2 which is implemented in the way described above using only one capacitor 11 and one inductor 12 and may thus be referred to as an LC coupler. Each gate of the LC coupler 2 is formed by two gate terminals. Each gate terminal of a gate is connected to a gate terminal of the particular neighboring gate via an ideal line, so that each two are coincident to form one gate terminal. Thus, for example, the gate terminal 5*a* of the input gate 5 is connected via an ideal line to the gate terminal 7*a* of the first further gate 7, so that these two are coincident to form a joint gate terminal. The gate terminals 7*b* and 9*a*, 9*b* and 10*b*, and 10*a* and 5*b* are also each coincident to form a joint gate terminal, so that the LC coupler 2 actually only has four gate terminals. The capacitor 11 and the inductor 12 are connected between these four gate terminals in such a way that the capacitor 11 connects the joint gate terminal of the input gate 5 and the first further gate 7 to the joint gate terminal of the load gate 10 and the second further gate 9, and the inductor 12 connects the joint gate terminal of the input gate 5 and the load gate 10 to the joint gate terminal of the first further gate 7 and the second further gate 9.

The phase shift necessary for the function of the 0°/90° coupler 2 is obtained for the provided operating frequency of the LC coupler via suitable dimensioning of the capacitor 11 and the inductor 12, for which a brief example is explained in the following according to the known computing rules.

In this example, the system impedance of the LC coupler is $Z_0$=50 ohm and the operating frequency is $f_0$=2 GHz. The resistance $Z_1$ of a capacitor C and the resistance $Z_2$ of an inductor L may then be determined by $$Z_1=1/\omega_0 C$$

$$Z_2=\omega_0 L \text{ with } \omega_0=2\pi f_0$$

Using the conditions known for a resonant circuit $$Z_1+Z_2=0 \text{ and} \quad 1.$$

$$Z_1 * Z_2=Z_0^2 \quad 2.$$

the values for the inductor L in the capacitor C may be determined as $$L=Z_0/2\pi f_0=3.97nH$$

$$C=1/\omega_0^2 L=1.59pF$$

Using this dimensioning of the capacitor and the inductor, a phase shift of 0° or 90° is achieved for the selected operating frequency of 2 GHz. The LC coupler is thus a mono-band 0°/90° coupler for an operating frequency of 2 GHz.

A special feature of this 0°/90° coupler is that a point of the circuit may be connected to ground, so that two asymmetrical gates result. For example, if the joint gate terminal of the input gate 5 and the load gate 10 is connected to ground, asymmetrical components may be connected to these two gates. This is thus a 0°/900 coupler 2 having integrated balun functionality.

If one exchanges the placement of capacitor 11 and inductor 12, a 0°/90° coupler which may be used alternatively thus results.

Furthermore, the two individual antennas 3*a*, 3*b* and the input gate 5 may either be implemented in symmetrical conductor technology in this 0°/90° coupler, or all three components must be implemented in asymmetrical conductor technology. In contrast, if a component to be connected is designed asymmetrically to the others, a symmetry element is to be connected between the gate and the component in a known way to restore the symmetry. A so-called balun (balanced-unbalanced) may be used here, which may be implemented as a transformer, for example.

Figure 4:
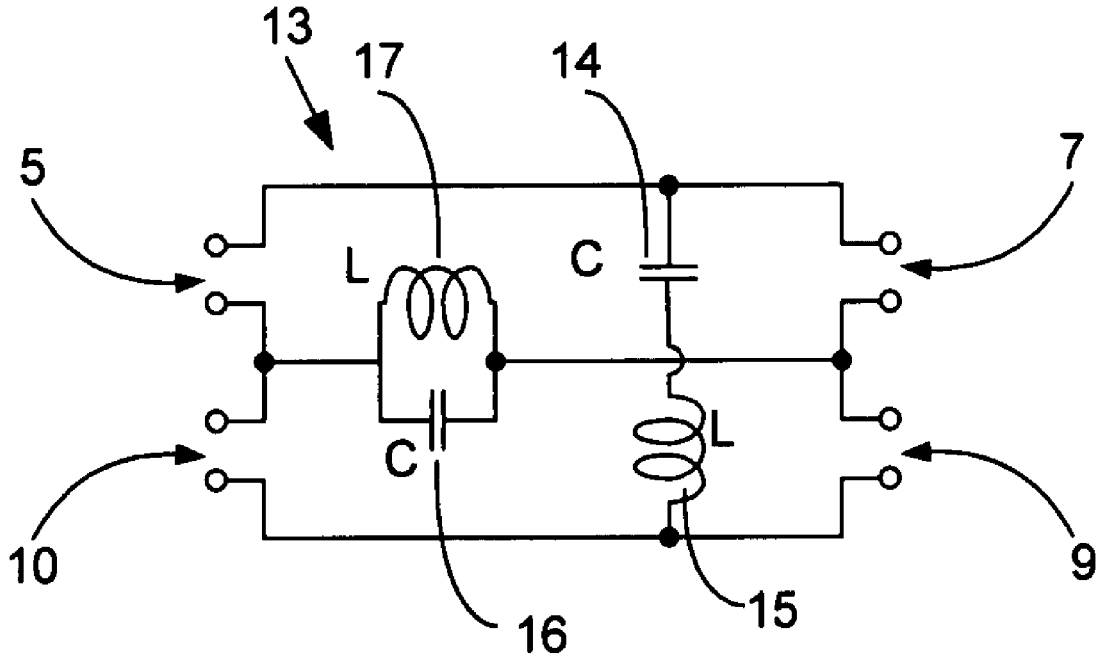
FIG. 4: shows a circuit diagram of a −90°/90° dual band coupler.

FIG. 4 shows a circuit diagram in which a mono-band coupler described above is refined to form a −90°/90° dual band coupler 13. Like the previously described mono-band 0°/90° coupler 2, the −90°/90° coupler 13 has an input gate 5 and a load gate 10 as well as a first gate 7 and a second further gate 9. The inductor used in the 0°/90° coupler and the capacitor are replaced here by a parallel oscillating circuit, which is formed by the inductor 17 and the capacitor 16, or a series oscillating circuit, which is formed by the capacitor 14 and the inductor 15. The mode of operation of the two operating frequencies of the dual band coupler 13 is identical to that of the LC coupler and the CL coupler. The dual band coupler thus acts as a 90° coupler for the lower of the two operating frequencies of the dual band coupler 13 and as a −90° coupler for the higher operating frequency. If one exchanges the parallel oscillating circuit with the series oscillating circuit in this variation of the coupler 13, the dual band coupler 13 accordingly behaves as a −90° coupler at the lower operating frequency and as a 90° coupler at the higher operating frequency. The particular mid-frequencies of the two operating frequencies of the dual band coupler do not have to have any particular spacing from one another.

The invention claimed is:

1. An antenna architecture for non-interacting connection of an antenna to a power amplifier, wherein the antenna is connected via an LC coupler to the power amplifier, the LC coupler has an input gate for feeding the signal to be transmitted to the antenna and a first antenna gate and a second antenna gate for transmitting the signal to the antenna, the antenna has a first individual antenna and a second identical individual antenna, the first individual antenna is connected to the first antenna gate and the second individual antenna is connected to the second antenna gate, a load gate is terminated, and the LC coupler transmitting the signal on the first antenna gate using a first phase and transmitting the signal on the second antenna gate using a second phase shifted by 90° to the first phase.

2. The antenna architecture according to claim 1, wherein the load gate is terminated using an adapted terminating resistor.

3. The antenna architecture according to claim 2, wherein the terminating resistor is an equivalent resistance.

4. The antenna architecture according to claim 3, wherein the terminating resistor has at least one further coupler having an antenna.

5. The antenna architecture according to claim 4, wherein the further coupler has an input gate for feeding the signal to be transmitted to its antenna and a first antenna gate and a second antenna gate for transmitting the signal to its antenna and also a load gate, its antenna has a first individual antenna and a second identical individual antenna, its first individual antenna being connected to its first antenna gate and its second individual antenna being connected to its second antenna gate, its load gate is terminated, and the coupler transmits the signal on its first antenna gate using a first phase and on its second antenna gate using a second phase shifted by 90° to the first phase.

6. The antenna architecture according to claim 1, wherein a gate terminal of the load gate is connected to ground.

7. The antenna architecture according to claim 1, wherein the input of the LC coupler is implemented in asymmetrical conductor technology and the individual antennas, are each implemented in symmetrical conductor technology.

8. An LC coupler, in particular a high-frequency coupler, having an input gate, a load gate, and a further first gate and a second gate, each gate being formed by a first gate terminal and a second gate terminal, associated signal transmission paths existing between the input gate and each of the further gates, and the first gate terminal of the input gate and the first gate terminal of the first further gate being short-circuited, the second gate terminal of the input gate and the first gate terminal of the load gate being short-circuited, the second gate terminal of the first further gate and the first gate terminal of the second further gate being short-circuited, and the second gate terminal of the second further gate and the second gate terminal of the load gate being short-circuited, wherein the first gate terminal of the input gate is connected via a first LC element to the second terminal of the second further gate and the second gate terminal of the input gate is connected via a second LC element to the second gate terminal of the first further gate, and the dimensioning of the two LC elements causes a phase shift of 90° in the provided operating frequency range between the two signal transmission paths.

9. The LC coupler according to claim 8, wherein the first LC element is a capacitor.

10. The LC coupler according to claim 8, wherein the second LC element is an inductor.

11. The LC coupler according to claim 8, wherein the first LC element is an inductor.

12. The LC coupler according to claim 8, wherein the second LC element is a capacitor.

13. The LC coupler according to claim 8, wherein the LC coupler has two operating frequency ranges and the two LC elements comprise both capacitors and also inductors, the capacitor of one of the two LC elements and the inductor of the other of the two LC elements being dimensioned in such a way that the dimensioning causes a phase shift of 90° in a first of the two operating frequency ranges between the two signal transmission paths, while the inductor of one of the two LC elements and the capacitor of the other of the two LC elements are dimensioned in such a way that the dimensioning causes a phase shift of 90° between the two signal transmission paths in the second of the two operating frequency ranges.

14. The LC coupler according to claim 8, wherein at least one of the two LC elements has a capacitor and an inductor situated parallel thereto.

15. The LC coupler according to claim 8, wherein at least one of the two LC elements has a capacitor and an inductor situated in series thereto.

16. The LC coupler according claim 8, wherein a preferably an ohmic load resistor is provided at the load gate.

17. The LC coupler according to claim 16, wherein the load resistor is situated between the first gate terminal and the second gate terminal of the load gate.

18. An LC coupler according at least two couplers according to claim 8, wherein one of the two couplers is connected via its input gate to the load gate of the other of the two couplers.

19. The LC coupler according to claim 18, wherein the first gate terminal of the input gate of the first of the two couplers is short-circuited with the second gate terminal of the load gate of the second coupler.

20. The LC coupler according to claim 19, wherein a load resistor is provided in the load gate of the first coupler.

* * * * *

UNITED STATES PATENT AND TRADEMARK OFFICE

CERTIFICATE OF CORRECTION

PATENT NO. : 7,812,780 B2
APPLICATION NO. : 11/667508
DATED : October 12, 2010
INVENTOR(S) : Heuermann It is certified that error appears in the above-identified patent and that said Letters Patent is hereby corrected as shown below:

Column 8, lines 46-47, (Lines 2-3 of Claim 16) after the word "wherein", please delete: "a preferably".

Signed and Sealed this

Seventh Day of December, 2010

David J. Kappos

David J. Kappos
*Director of the United States Patent and Trademark Office*